United States Patent [19]

Poppe et al.

[11] Patent Number: 5,071,260

[45] Date of Patent: Dec. 10, 1991

[54] PROFILED BOTTOM BAG WITH CARRYING HANDLE AND A PROCESS FOR MANUFACTURING PROFILED BOTTOM BAGS

[75] Inventors: Josef Poppe, Tecklenburg; Helmut Selimeier, Lengerich; Ewald Jostmeier, Mettingen, all of Fed. Rep. of Germany

[73] Assignee: Bishof und Klein GmbH & Co., Lengerich, Fed. Rep. of Germany

[21] Appl. No.: 500,429

[22] Filed: Mar. 28, 1990

[30] Foreign Application Priority Data

Apr. 29, 1989 [DE] Fed. Rep. of Germany ..... 8905480

[51] Int. Cl.[5] ..... B65D 33/06

[52] U.S. Cl. ..... 383/21; 383/20; 383/30

[58] Field of Search ..... 383/70, 21, 30; 229/117.23

[56] References Cited

U.S. PATENT DOCUMENTS

| | | | |
|---|---|---|---|
| 1,524,399 | 1/1925 | Krueger | 229/117.23 |
| 2,059,621 | 11/1936 | Belcher | 383/21 |
| 2,773,635 | 12/1956 | Stelzer | 229/117.23 |
| 3,206,104 | 9/1965 | Cohen | 229/117.23 |
| 3,208,492 | 9/1965 | Braithwaite | 383/20 |
| 3,514,033 | 5/1970 | Goodwin | 383/21 |
| 4,119,268 | 10/1978 | Segura | 383/21 |

FOREIGN PATENT DOCUMENTS 329058 8/1989 European Pat. Off. ..... 383/21

*Primary Examiner*—Gary E. Elkins

*Attorney, Agent, or Firm*—Jordan and Hamburg

[57] ABSTRACT

A profiled bottom bag made of paper, plastic foil or a similar foldable material has at least one profiled end provided at its outside with a handle-forming strip whose length is essentially that of the profiled end. A handle section extends between connected areas and, in contrast to the connecting areas, is narrower. The handle-forming strip forms part of a prefabricated cut section encompassing a separating strip which extends under the handle section of the handle-forming strip without being bonded thereto, whose width corresponds to that of the handle-forming strip in the end-connecting areas of the strip, whose length, measured in the longitudinal direction of the profiled end, but in contrast to the length of the handle-forming strip, is shorter up to the narrow connecting areas on both sides of the handle section of the handle-forming strip. The separating strip and the handle-forming strip are bonded together. The undersides of the end-connecting area of the hanndle-forming strip and the underside of the separating foil are bonded to the outside of the profiled end and essentially completely covers the profiled end in the form of a cover.

7 Claims, 2 Drawing Sheets

PROFILED BOTTOM BAG WITH CARRYING HANDLE AND A PROCESS FOR MANUFACTURING PROFILED BOTTOM BAGS

BACKGROUND OF THE INVENTION

This invention relates to a profiled bottom bag with a carrying handle, made of paper, plastic foil or a similar foldable material, with at least one of the two profiled bottoms being provided at its outside with a handle-forming strip of essentially the length of the bottom, which extends in the longitudinal direction of the bottom on both sides of a central line of symmetry, said handle-forming strip encompassing the end-connecting areas of essentially the width of the bottom and a handle section which extends between said connecting areas and, in contrast to said connecting areas, becomes narrower.

With known profiled bags, in particular crossed bottom or gusseted bags, made of paper, plastic sheet or a similar foldable material, the affixing of the separate handle-forming strips, if necessary, in combination with an outer bottom cover which is provided with the outside contour of the profiled bottom, involves comparatively high manufacturing and material costs and/or the handle strips are suitable only for carrying small loads, because of technically inadequate materials or bonding.

SUMMARY OF THE INVENTION

In view of the foregoing, it is the object of the present invention to provide a profiled bottom bag with carrying handle, made of paper, plastic sheet or a similar foldable material, which can be produced by simple means and at low material cost and which has a high break resistance.

On the basis of a profiled bottom bag of the type described in the foregoing, this problem is solved in accordance with the invention, in that the handle-forming strip forms part of the prefabricated cut section encompassing a separating foil which grips under the handle section of the handle-forming strip without being bonded thereto, whose width corresponds to that of the handle-forming strip located in the end-connecting areas of said strip, whose length, measured in the longitudinal direction of the bottom, in contrast to that of the handle-forming strip, is shortened up to the narrow connecting areas on both sides of the handle section of the handle-forming strip, in which the separating foil and the handle-forming strip are interconnected, and that the cut section with its free underside, comprising the undersides of the end-connecting areas of the handle-forming strip and the underside of the separating foil, is completely covered and bonded as one whole with the outside of the profiled bottom in the form of a bottom cover.

The profiled bottom bag with carrying handle according to the invention can be manufactured by a simple method, in that from a first length of material, whose width and length correspond to the profiled bottom, oblong holes of the width of the profiled bottom are punched out at suitable intervals at right angles to the longitudinal center line of the first length of material; a second length of material, whose width overlaps on both sides the longitudinal dimension of the oblong holes punched out of the first length of material, but is narrower than the width of the first length of material, is bonded to its surface to the bottom side of the first length of material in the area of the edges which overlap the longitudinal dimension of the oblong holes of the first length of material; the combined lengths of material are subdivided into individual cut sections by way of transversal cuts along the longitudinal center line of the punched out holes, and the underside of each individual cut section is bonded to the outside of a profiled bottom of a profiled bottom bag.

This enables a fully automatic production in the course of which the cut sections can be applied to the profiled bottom by means of the usual machine aggregates, for example, using a known apparatus for applying bottom covers. For this process, it is recommended that the combined lengths of material, before subdividing them into individual cut sections, be rolled onto a supply roller and unrolled again from said roller for the subdividing process after said roller has been installed in a bag-making machine in order to supply the application apparatus.

In the development according to the invention of the profiled bottom bag with carrying handle, the cut section fulfills the function of an external bottom cover of the profiled bottom and, at the same time, that of a carrying handle, because, according to the invention, the end-connecting areas of the handle-forming strip and of the separating foil, together with the undersides composed by the aforesaid method, jointly form a combined cut of material of whose contour corresponds to that of a profiled bottom in the form of a normal single bottom cover. Due to the large connecting areas of the handle-forming strip, which conform with the bottom width, the handle-forming strip has a high degree of break resistance, without impairing the user's carrying comfort in spite of the fact that the handle section of the handle-forming strip is narrower than the connecting areas.

Other characteristics and advantages of this invention are specified in the claims and the following description in conjunction with the drawing, in which an exemplary embodiment of the object of the invention is shown in a diagrammatic section.

DESCRIPTION OF THE PREFERRED EMBODIMENTS

Figure 1:
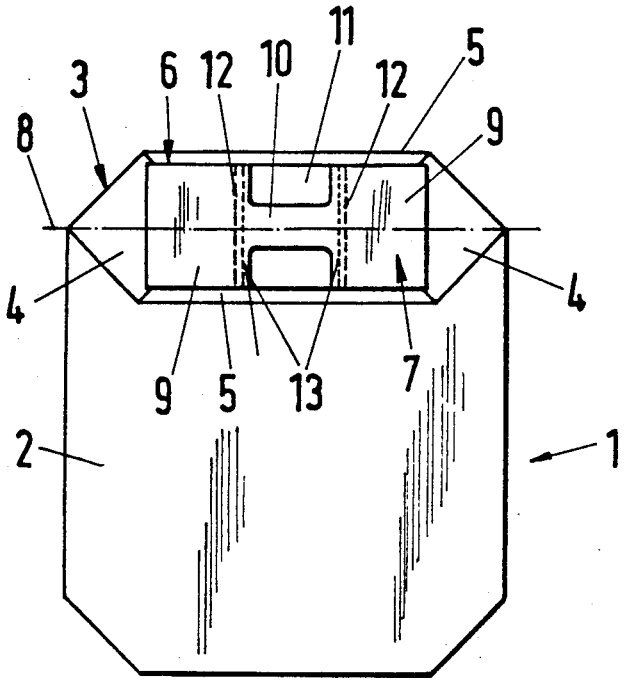
FIG. 1 shows a view of the profiled bottom bag in an empty condition, including a horizontal projection of a profiled bottom with carrying handle.

FIG. 1 shows the whole profiled bottom bag 1 which can be made of paper, plastic sheet or a similar foldable or flexible material. The profiled bottom bag has the shape of a cross bottom back and is shown in FIG. 1 in an empty condition in which the two walls 2 of the bag are positioned flat adjacent to each other. The upper profiled bottom 3 is folded into the plane of the front wall 2, while the lower profiled bottom is folded up to the opposite wall of the bag and, therefore, is not shown. The profiled bottom 3 comprises the two corner folds 4 and bottom folds 5, in the same way as they exist in cross bottoms, which are located in pairs opposite to one another.

Figure 2:
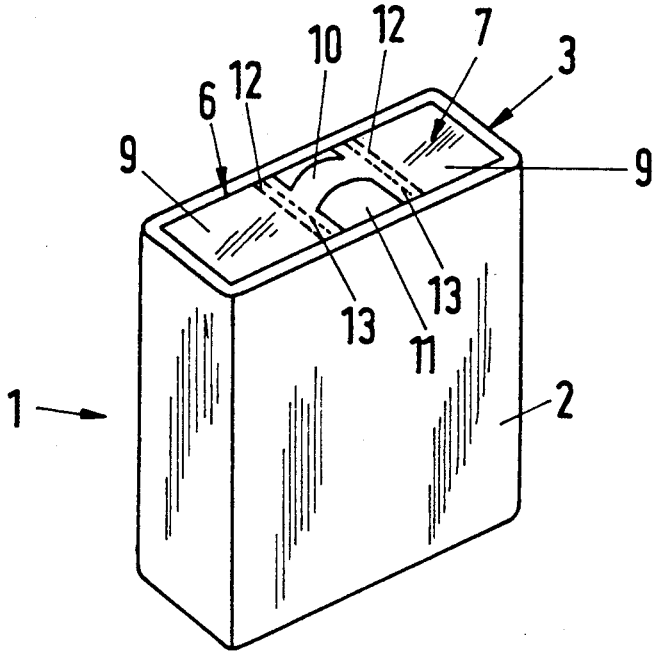
FIG. 2 shows a perspective of the profiled bottom bag in accordance with FIG. 1 in a filled condition.

On the profiled bottom 3 there is bonded the underside of a cut section 6 whose contour correspond to that of the profiled bottom 3, but which is dimensioned slightly smaller than that of said profiled bottom. The cut section 6 encompasses a handle-forming strip 7 which extends on both sides of a central line of symmetry 8 of the bottom 3 and essentially has the same length as the profiled bottom 3, which occurs when the square-shaped bag is filled (FIG. 2). The handle-forming strip 7 is provided at its ends with connecting areas 9 whose width corresponds to that of the profiled bottom 3. Between the two connecting areas 9 there extends a central handle section 10 which, in contrast to said connecting areas, is narrower.

Further, the cut section 6 encompasses a separating foil 11, which is unbonded and clasps under the handle section 10 of the handle-forming strip 7. The width of the separating foil 11 is similar to the width of the end-connecting areas 9 of the handle-forming strip 7. The length of the separating foil 11, which is measured in the longitudinal direction of the bottom, i.e. parallel to the line of symmetry 8, is, in contrast to the length of the handle-forming strip 7, shortened up to the narrow connecting areas 12 on both sides of the handle section 10 of the handle-forming strip 7. In these connecting areas 12, the separating foil 11 and the handle-forming strip 7 are respectively bonded together by an adhesive joint 13 which extends transversely to the line of symmetry 8 of the profiled bottom 3. In order to prevent the handle section 10 of the handle-forming strip 7 from ripping in the transition areas of the connecting areas 9, the handle section 10 on both sides of the central line of symmetry 8 passes at both ends, in each case with a rounded off end section of its outer edge, into the adjacent outer edge of the connecting areas 9 of the strip 7 forming the handle, said outer edge being at right angles to the line of symmetry 8.

The cut section 6 with its free underside, comprising the undersides of the end-connecting area 9 of the handle-forming strip 7 and the underside of the separating foil 10, by means of applying adhesive all over the underside, is bonded as one whole with the outside of the profiled bottom 3 in such a way that the outside of the profiled bottom 3, in the form of a bottom cover, is essentially completely covered by the cut section 6. If the profiled bottom bag 1 is in a filled condition, as is shown in FIG. 1, the handle section 10 of the strip 7 forming the handle, in contrast to the separating foil 11 whose surface lies unbonded underneath said handle section, can easily be seized by the user in order to carry the profiled bottom bag 1.

Figure 3:
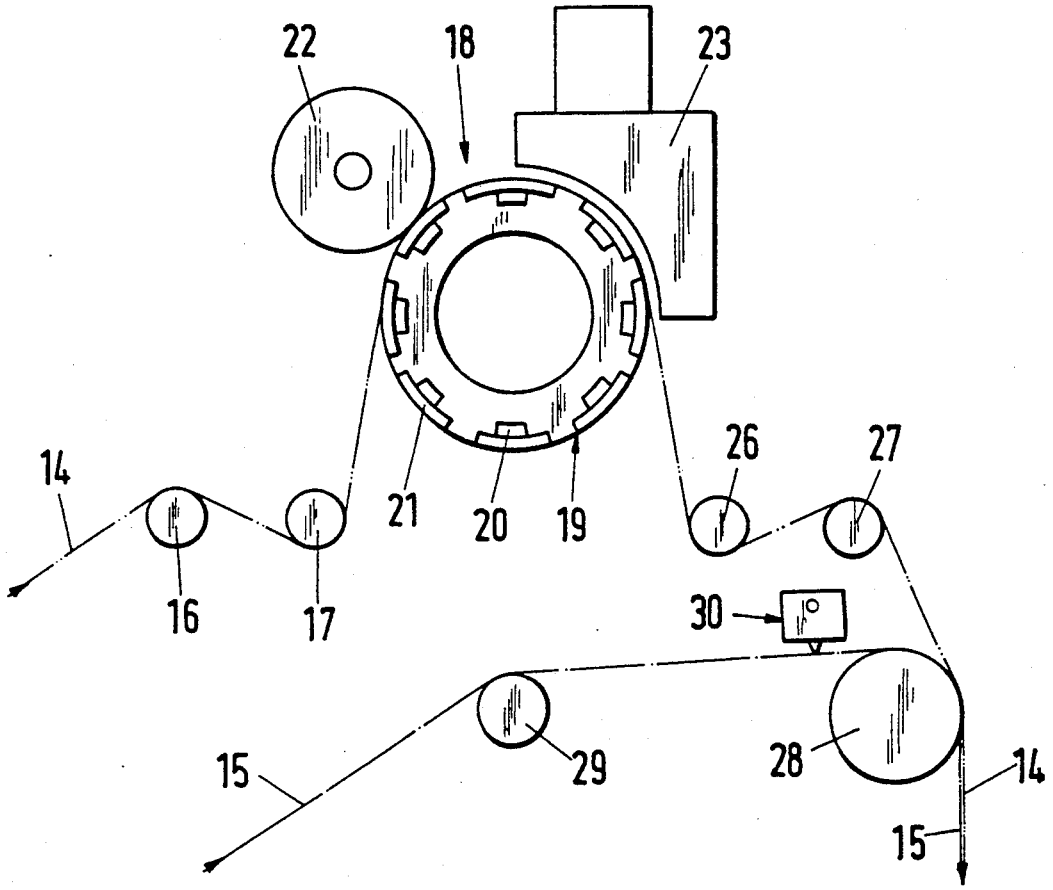
FIG. 3 shows a lateral view of an apparatus for manufacturing cut sections consisting of two lengths of material to be applied to a profiled bottom, which are encompassed by a carrying handle.
Figure 4:
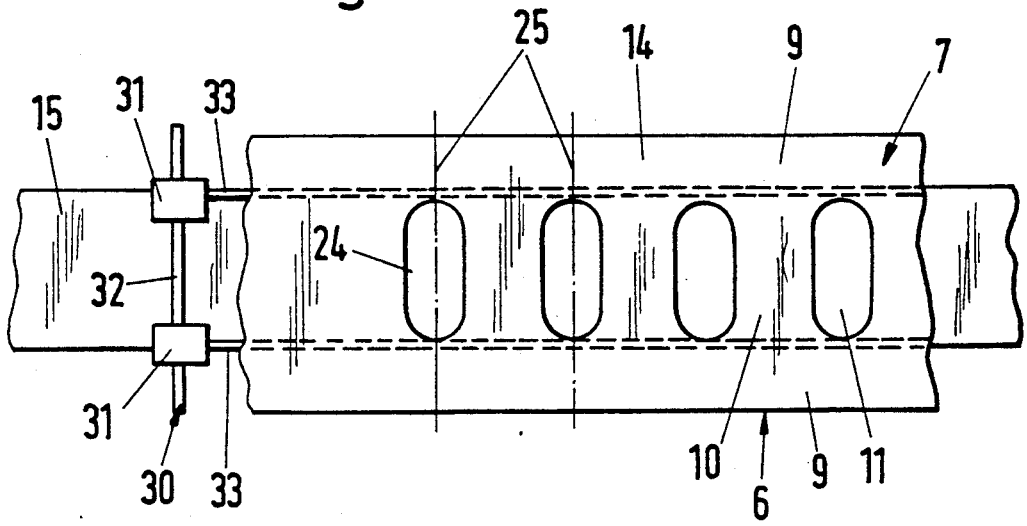
FIG. 4 shows a horizontal projection of a section of the apparatus in accordance with FIG. 3.

Two lengths of material 14 and 15 are used for producing the cut sections 6, as is shown FIG. 3 and 4 and explained in the following. The lengths of material 14 and 15 can consist of a suitable plastic sheet or any other material which meets the necessary strength and processing requirements. The lengths of material 14 and 15 are unrolled from the supply roller (not shown) and fed to the individual processing stations.

The width and length of the material 14 correspond to the profiled bottom 3, which is fed via deflection pulleys 16 and 17 of a hole punching station 18 by means of a preferred installation (not shown). The hole punching station 18 comprises a cutting drum 19 with punching tools 20 arranged equidistant in its circumference, which are adjustably attached in the recesses 21 of the cutting drum 19. The cutting drum 19 operates in conjunction with a back pressure roller 22, while the length of material 14 is fed between the cutting drum 19 and the back pressure roller 20 to perform the hole punching process. In the course of the operation, the length of material 14 winds around the cutting drum 14 which, from section to section, following the contours of the outer circumference of said drum, is surrounded by a suction apparatus 23 in order to exhaust waste.

In the hole punching station 18, oblong holes 24 (FIG. 4) are punched out at suitable intervals in the width of the profiled bottom 3, whose longitudinal center lines 25 extend transversal to the length of material 14. Thereafter, the length of material 14 is fed via further deflection pulleys 26 and 27 to a deflection roller 28 at which the length of material 14 is combined with the length of material 15.

The width of the length of material 15 overlaps on both sides the longitudinal dimension of the oblong holes 24 punched out in the length of material 14, but is clearly narrower than the width of the length of material 14. The length of material 15 is fed via a deflection pulley 29 to an adhesive applicator 30 comprising two adhesive application elements 31 which are adjustably supported in the longitudinal direction on a connector bar 32. By means of the adhesive application elements 31, adhesive 33 is applied in the longitudinal direction of the length of material 15 in a continuous, parallel, linear manner to the longitudinal edges of the surface of the length of material 15, whose transversal ends overlap the punched out holes 24, which in the individual cut sections 6 form the adhesive joints 13 in the connecting areas 12. Then the length of material 15, whose surface is provided with the adhesive applications 33, is joined at the deflection roller 28, around which said length of material is wound, with the length of material 14 which is also wound around the deflection roller 28 and, at the same time, bonds the underside of said length of material carrying the adhesive application 33 onto the surface of the length of material 15.

The two bonded lengths of material 14 and 15 can then be rolled onto a supply roller which, if required, can be installed in a bag-making machine, in order to supply an apparatus for applying the cut sections 6 to the outside of a profiled bottom 3. Of the length of material 14 unrolled from the supply roller, individual cut sections 6 are separated by transversal cuts, by means of a suitable cutting apparatus, along the longitudinal center line 25 passing through the punched out holes 24, whereupon the underside of said cut sections is provided with an adhesive application, preferably all over the critical area of application, and is then bonded, in a manner not shown in the drawing, to the outside of the profiled bottom 3 of an allocated profiled bottom bag 1. The sections of the length of material 14 thus form the handle-forming strip 7, while the sections of the length of material 15 form the separating foil 11 of each cut section 6.

What we claim is:

1. A bag made of a foldable material and having a carrying handle, said bag having a flat folded state in which said bag has a flat profiled end having a longitudinal axis of symmetry, said profiled end having a generally rectangular configuration when said bag is filled, a handle-forming means secured to said profiled end of said bag, said handle-forming means comprising an elongate handle-forming strip and an intermediate strip, said handle-forming strip having a central portion and two spaced end portions, said central portion having a width which is less than the width of said end portions, said intermediate strip underlying said central portion of said handle-forming strip and also underlying at least parts of said end portions of said handle-forming strip, first adhesive means adhering said end portions of said handle-forming strip to said intermediate strip, and second adhesive means adhering said end portions of said handle-forming strip and said intermediate strip to said profiled section of said bag, said central portion non-adheringly overlying said intermediate strip to thereby form a handle for said bag.

2. A bag according to claim 1, wherein said first adhesive means comprising two spaced seams of adhesive extending across the width of said handle-forming means and which are perpendicular to said line of symmetry.

3. A bag according to claim 1, wherein said underlying strip underlies parts of each end portion of said handle-forming strip, said parts extending across the width of said handle-forming means, said first adhesive means being disposed between said parts of said handle-forming strip and said underlying strip.

4. A bag according to claim 1, wherein said central portion of said handle-forming strip has longitudinal edges, said two end portions of handle-forming strip having transverse inner edges, said handle-forming strip having rounded corners connecting said longitudinal edges to said transverse edges.

5. A bag according to claim 1, wherein said intermediate strip has terminating ends extending across the width of said handle-forming means, said handle-forming strip having terminating ends extending across the width of said handle-forming means, said second adhesive means being disposed between said handle-forming strip and said profiled end in the areas between said terminating ends of said intermediate strip and the terminating ends of said handle-forming strip.

6. A bag according to claim 5, wherein said second adhesive means is disposed between said intermediate strip and said profiled end in the area between said terminating ends of said terminating strip.

7. A bag according to claim 1, wherein said handle-forming means is initially formed as a single unit by adhesively securing said handle-forming strip to said underlying strip with said first adhesive means, said unit formed handle-forming means being subsequently adhesively adhered to said profiled end of said bag by said second adhesive means.

* * * * *